US005645896A

United States Patent [19]

Mills

[11] Patent Number: 5,645,896

[45] Date of Patent: Jul. 8, 1997

[54] METHOD OF APPLYING A FILLED IN METAL CARBIDE HARD FACING TO THE ROTOR OF A PROGRESSING CAVITY PUMP

[75] Inventor: Robert A.R. Mills, Bragg Creek, Canada

[73] Assignee: Kudu Industries Inc., Canada

[21] Appl. No.: 588,141

[22] Filed: Jan. 18, 1996

Related U.S. Application Data

[62] Division of Ser. No. 454,589, May 30, 1995, Pat. No. 5,498,142.

[51] Int. Cl.[6] ..... C23C 4/10

[52] U.S. Cl. ..... 427/450; 427/355; 428/457; 428/627; 428/698; 418/48; 418/178

[58] Field of Search ..... 427/450, 454, 427/455, 456, 355; 418/48, 178, 179; 428/457, 698, 681, 627, 615

[56] References Cited

U.S. PATENT DOCUMENTS

| | | | |
|---|---|---|---|
| 3,615,099 | 10/1971 | Prasse | 277/235 |
| 5,217,746 | 6/1993 | Lenling et al. | 427/450 |
| 5,395,221 | 3/1995 | Tucker, Jr. et al. | 418/48 |

FOREIGN PATENT DOCUMENTS

| | | | |
|---|---|---|---|
| 746458 | 11/1966 | Canada . | |
| 785248 | 5/1968 | Canada . | |
| 1326414 | 4/1994 | Canada . | |
| 0018265 | 10/1980 | European Pat. Off. . | |
| 6-10110 | 1/1994 | Japan | 427/450 |
| 1434365 | 3/1982 | United Kingdom . | |
| 2083079 | 3/1982 | United Kingdom . | |
| 2228976 | 9/1990 | United Kingdom . | |

OTHER PUBLICATIONS

Thermal Spray, Practice, Theory, and Application, American Welding Society, Inc., 1985, p. 27 (no month date).

*Primary Examiner*—Katherine A. Bareford
*Attorney, Agent, or Firm*—Andrus, Sceales, Starke & Sawall

[57] ABSTRACT

A hardfacing for downhole progressing cavity pumps is disclosed as well as a method for producing same. The hardfacing consists of a metal carbide layer applied to the ferrous pump rotor body by way of plasma spraying and a top layer of metallic material having a lower hardness than the metal carbide. The metal carbide layer has a grainy surface with a plurality of peaks and intermediate depressions, the peaks being formed by metal carbide grains at the surface of the metal carbide layer. The thickness of the top layer is adjusted such that the depressions between the peaks of the metal carbide layer are completely filled thereby providing the rotor with a metal carbide hardfacing of significantly reduced surface roughness. In the process of the invention, the pump rotor, which may be provided with a molybdenum bonding layer, is plasma coated with the metal carbide and the resulting carbide layer is covered with the metallic material top layer. The top layer is polished either until the dimensions thereof are within the tolerances acceptable for the finished rotor or until a majority of the peaks of the carbide layer are exposed. The hardfacing significantly increases the service life of the rotor and stator of downhole progressing cavity pumps.

10 Claims, 2 Drawing Sheets

METHOD OF APPLYING A FILLED IN METAL CARBIDE HARD FACING TO THE ROTOR OF A PROGRESSING CAVITY PUMP

This is a division of application Ser. No. 08/454,589, filed May 30, 1995, now U.S. Pat. No. 5,498,142.

FIELD OF THE INVENTION

The invention relates to wear-resistant hardfacings for movable parts and especially to hardfacings for rotors of progressing cavity pumps.

BACKGROUND OF THE INVENTION

Progressing cavity pumps have been used in water wells for many years. More recently, such pumps have been found well suited for the pumping of viscous or thick fluids such as crude oil laden with sand. Progressing cavity pumps include a stator which is attached to a production tubing at the bottom of a well and a rotor which is attached to the bottom end of a pump drive string and is made of metallic material, usually high strength steel. The rotor is usually electro-plated with chrome to resist abrasion, but the corrosive and abrasive properties of the fluids produced in oil wells frequently cause increased wear and premature failure of the pump rotor. Since it is important for efficient operation of the pump that a high pressure differential be maintained across the pump, only small variations in the rotor's dimensions are tolerable. This means that excessively worn rotors must be replaced immediately. However, replacement of the rotor requires pulling the whole pump drive string from the well which is costly, especially in the deep oil well applications which are common for progressing cavity pumps. Consequently, pump rotors with increased wear resistance and, thus, a longer service life are desired to decrease well operating cost.

Various hardfacing methods have been used in the past to increase the wear resistance of metal surfaces. Hardfacings consisting of a thin layer of metal carbide applied by conventional plasma jet spraying techniques are the most commonly used due to the extreme hardness of the coating achieved. However, although this type of hardfacing works well when in friction contact with a metal surface, surfaces so coated have a roughness which makes them unacceptable for use in progressing cavity pump applications. The surface roughness of the metal carbide hardfacing is due to the grainy structure of the hardfacing structure which is caused by the individual sprayed-on metal carbide particles. This roughness results in excessive wear of the progressing cavity pump stator which is made of an elastomeric material, most often rubber. Polishing of the metal carbide hardfacing to overcome this problem is theoretically possible, but cannot be done economically due to the extreme hardness of the material. Thus, an economical hardfacing for progressing cavity pump rotors is desired which increases the surface life of the rotor without increasing stator wear. In particular, a hardfacing is desired which provides the surface hardness and wear characteristics of a metal carbide coating without having the same surface roughness.

The hardfacing of metal surfaces with tungsten carbide or tungsten carbide containing metal powders by plasma spraying or detonation gun is well known in the art and is disclosed in the following references.

Canadian Patent 746,458, McFarland et al;

Canadian Patent 785,248, Rath;

Canadian Patent 1,326,414, Jackson et al;

U.S. Pat. No. 3,615,009, Prasse;

European Patent Application 0,018,265, Bonnin;

British Patent 1,434,365, Land et al;

British Patent Application 2,083,079, Tenkula et al.

Jackson et al (CA1,326,414), Bonnin (P0,018,265), Tenkula et al (GB2,083,079) and Rath (CA785,248), all disclose hardfacing layers made from plasma sprayed metal powders containing tungsten carbide together with additional metals such as cobalt, chromium, chromium oxide, chromium carbide, nickel, nickel/chromium, or iron. These additional metals are added to provide the coating with improved corrosion resistance and/or bonding. McFarland et al (CA746,458) teach a process for the application of a protective nickel/chromium alloy fusion coating onto a metal base to provide the base with improved corrosion resistance. Land et al (GB1,434,365) discuss mechanical seals wherein one of the seal surfaces is a metal alloy carbide. A plasma sprayed boron carbide coating is applied to the other sealed surface to provide the mechanical seals with increased corrosion and wear resistance. Thus, although various hardfacings are disclosed, all these references are directed to methods and coatings for the achievement of improved corrosion and wear resistance of the coated metal surfaces. No guidance can be found therein towards a solution for the increased wear problems expected at metal/rubber interfaces with plasma sprayed hardfacings of the metal surface.

The invention now provides a multiple layer hardfacing for a progressing cavity pump rotor which overcomes the problem of excessive stator wear experienced in progressing cavity pumps having rotors with conventional metal carbide hardfacings.

SUMMARY OF THE INVENTION

It is an object of the invention to provide a progressing cavity pump of increased service life.

It is a further object of the invention to provide a hardfacing for a progressing cavity pump rotor which increases rotor life and reduces stator wear.

It is yet another object of the invention to provide an economical metal carbide hardfacing for a progressing cavity pump rotor which has a low surface roughness.

These and other objects which will become apparent from the following are achieved with a hardfacing for a progressing cavity pump rotor in accordance with the invention. The hardfacing includes a layer of hard wearing metal carbide bonded to the metal body of the rotor and overlaid by a top layer of a softer metallic material, either a pure metal or a metal alloy, which can be polished more readily than the metal carbide coating. The top layer is applied at sufficient thickness to fill in the roughness of the metal carbide layer or completely cover the first layer and is subsequently polished to a smooth finish having dimensions within desired tolerances. Preferably, the top layer is polished until a majority of the peaks of the grainy metal carbide layer are exposed. This provides the rotor with a running surface which has the hard wearing characteristics but not the surface roughness of a pure metal carbide coating, since the grainy surface structure of the metal carbide layer is filled in by the metallic material of the second layer.

Accordingly, the invention provides a method of hardfacing a progressing cavity pump rotor having a ferrous metal rotor body, which includes the steps of plasma spraying a metal carbide material onto the rotor body to form a metal carbide hardfacing layer having a grainy surface with a multiplicity of peaks and intermediate depressions, the peaks being formed by metal carbide grains on the surface of the hardfacing layer, coating a top layer of metallic material onto the hardfacing layer to at least fill in the depressions intermediate the peaks, the metallic material being selected to have a lower hardness than the metal carbide; and polishing the top layer until the rotor is smooth and has dimensions within selected tolerances, and preferably until a majority of the peaks of the hardfacing layer are exposed to achieve a hardfacing surface of significantly reduced surface roughness.

The top layer can be of sufficient thickness to completely cover the metal carbide layer and can be made of a pure metal or a metal alloy. In addition, a molybdenum layer can be applied directly onto the rotor body and prior to application of the carbide layer to increase the bonding of the latter to the rotor body. The metal carbide layer is preferably applied at such a thickness that the dimensions of the carbide layer are within the tolerances selected for the finished rotor.

In a preferred economical embodiment, the top layer is not polished until the majority of peaks of the carbide layer are exposed. The metal carbide layer is applied to a rotor body which has dimensions smaller than the dimensions for the finished rotor and the metal carbide layer is applied to such a thickness that the diameter of the rotor body coated with the metal carbide layer is within the selected tolerances for the finished rotor. The top layer is polished to achieve a smooth surface and only until the interference between the finished rotor and the stator is within acceptable limits. The rotor is put into service whereby the top layer is subjected to the usual wear experienced with conventional rotors. Then once the top layer is worn to the point where a majority of the peaks of the carbide layer are exposed, the intereference fit between the rotor and the stator is still satisfactory since the dimensions of the metal carbide layer are within the selected tolerances for the finished rotor.

According to another aspect, the invention provides a progressing cavity pump rotor of improved service life which includes a ferrous metal body;

a layer of a metal carbide material bonded to the body and having a grainy surface with a multiplicity of peaks and intermediate depressions, the peaks being formed by metal carbide grains at the surface of the first layer; and a top layer of metallic material bonded to the carbide layer, the thickness of the top layer being adjusted such that the depressions between the peaks of the first layer are completely filled while the majority of the peaks are exposed at the surface of the rotor, thereby providing the rotor with a metal carbide hardfacing of significantly reduced surface roughness.

The metal carbide material is preferably selected from among the carbides of tungsten, titanium, tantalum, columbium, vanadium, and molybdenum and the metallic material of the top layer is preferably selected from among chromium, molybdenum and nickel and alloys thereof.

In the preferred embodiment, the metal carbide layer is made of tungsten carbide and the second layer is made of chromium/molybdenum alloy or nickel/chromium alloy. The best results are achieved with a tungsten carbide layer having a thickness of 50 to 125 micrometer and a nickel/chromium layer of 75 to 150 micrometer. The metal powders used are preferably of the highest purity and the finest grain size available.

DESCRIPTION OF THE PREFERRED EMBODIMENTS

Figure 1:
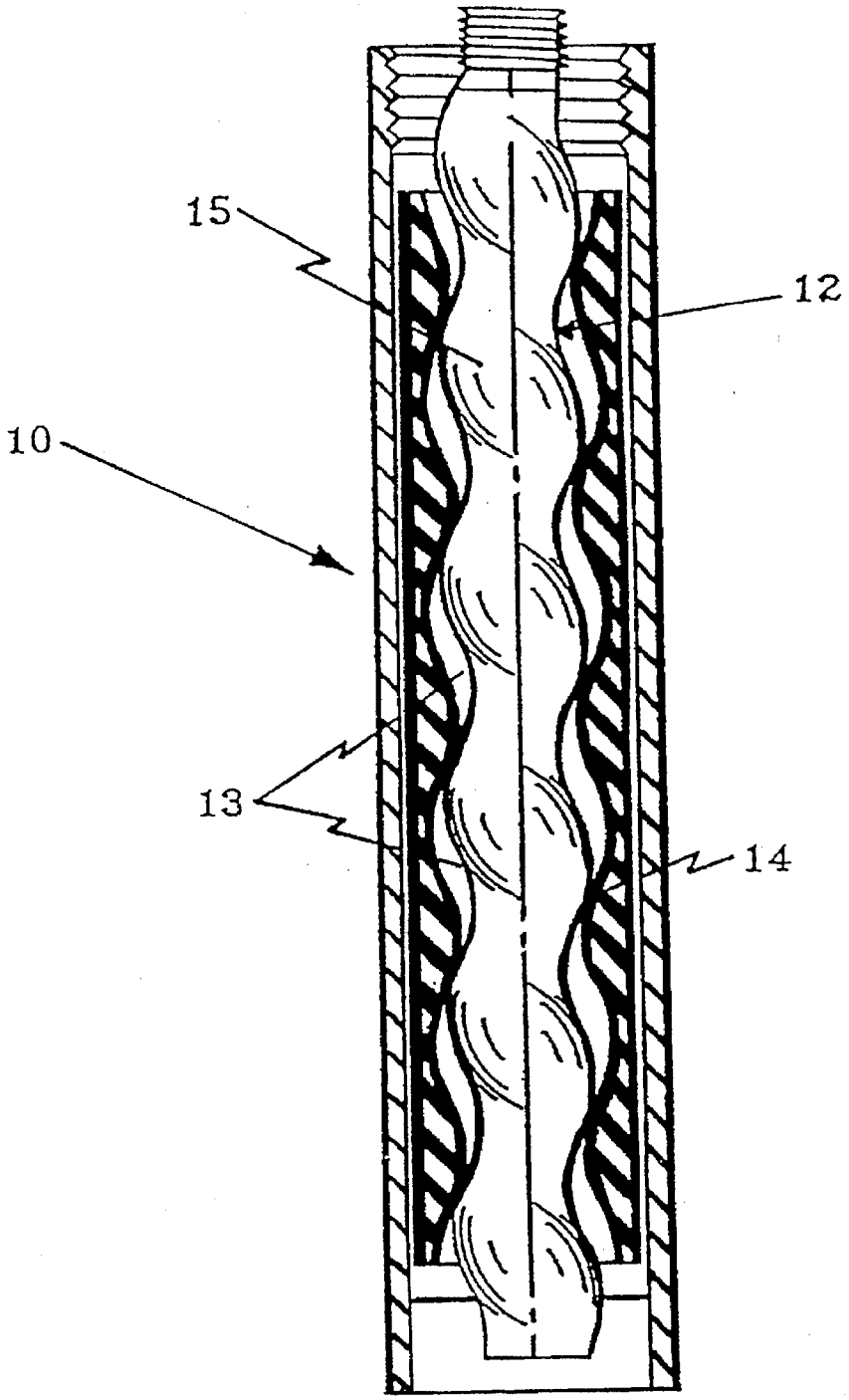
FIG. 1 shows the principal construction of a progressing cavity pump.

In the preferred embodiment, the hardfacing in accordance with the present invention is applied to the rotor of a progressing cavity pump 10 as shown in FIG. 1. Progressing cavity pumps include a helical rotor 12 made of ferrous metal, usually high strength steel, and a stator having a generally double hecical, rotor receiving bore 15 of twice the pitch length. The dimensions of the rotor and stator are coordinated such that the rotor tightly fits into the bore 15 and a number of individual pockets or cavities 13 are formed therebetween which are inwardly defined by the rotor 12 and outwardly by the stator 14. Upon rotation of the rotor 12 in the operating direction, the cavities 13 and their contents are pushed spirally about the axis of the stator 14 to the output end of the pump. The seal between the cavities is made possible by an interference fit between the rotor and the elastomeric material of the stator 14. The rotor 12 and stator 14 are at all times in tight contact in the areas between the cavities which results in the wear of both components and in particular the rotor, especially when sand-laden and corrosive liquids are pumped as is often the case in deep oil well applications.

Experiments with rotors having a metal carbide coming were unsatisfactory, since the metal carbide coating generally has a grainy surface, which causes significantly increased wear of the stator. The hardfacing in accordance with the invention has now been developed as a viable alternative to polishing of the metal carbide coating which is uneconomical due to the extreme hardness of the coating.

In the preferred embodiment, a metal carbide layer is plasma-sprayed onto the surface of the rotor, or onto a bond coating on the rotor, by way of a plasma spray gun and overlaid with a layer of metallic material which is polished to fit selected stator dimensions or until a major portion of the peaks of the underlying metal carbide layer are exposed.

Thermal spray coating processes and apparatus are well known in the art. Briefly, a plasma gun generally includes a pair of oppositely charged electrodes and an open-ended plasma chamber with arc-gas and metal powder injection ports. Upon introduction of a suitable arc-gas, for example argon, and generation of an arc resulting from a current crossing the gap between the electrodes, a zone of intense heat, a plasma, is formed which extends through the plasma chamber and emanates from the open end thereof. The magnitude of the heat in the plasma depends on the size of the electric current and the type of arc-gas used. A plasma-sprayed coating is formed by injecting a metal powder into the plasma chamber through the powder injection port. The powder is heated by the plasma to a molten or plastic condition and projected onto the base metal part to be coated. Upon impact, a bond is formed at the interface between the molten or plastic powder and the base metal part.

Figure 2:
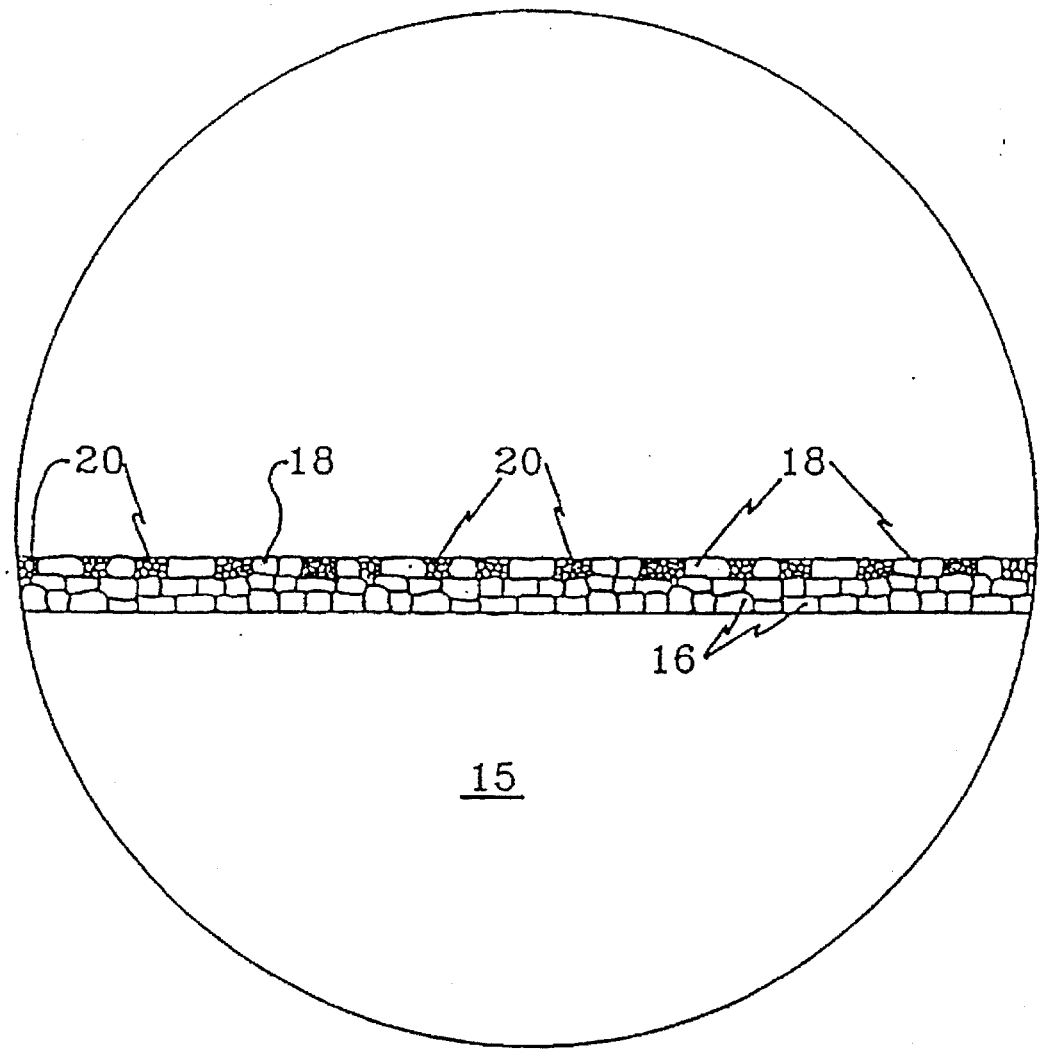
FIG. 2 is a partial cross-sectional view of a progressing cavity pump rotor provided with a hardfacing in accordance with the present invention showing in magnification the particles of the metal carbide and metal alloy layers in the hardfacing.

A magnification of the interface between the metal rotor body 15 and the hardfacing in accordance with the invention is shown in FIG. 2. Metal carbide powder particles 16 are bonded to the rotor body 15 and form a continuous layer. Those powder particles which were deposited last protrude from the metal carbide layer and provide the layer with a grainy surface having peaks 18 and intermediate depressions. In the preferred embodiment of the hardfacing in accordance with the invention, the metal carbide layer is made of tungsten carbide and the depressions in the surface thereof are completely filled with metal alloy particles, preferably nickel/chromium alloy particles. This greatly reduces the surface roughness of the metal carbide layer. Metal alloy powder is coated onto the metal carbide layer by plasma-spraying or other conventional coating process, such as electroplating, until full coverage is achieved, which means no more metal carbide particles are exposed. After cooling of the rotor, the metal alloy layer, which has a much lower hardness than the metal carbide layer, is polished smooth or until a major portion of the peaks 18 of the metal carbide layer are exposed. At that point, the surface of the rotor body 15 includes alternating metal carbide and metal alloy portions, since the depressions between the peaks are completely and evenly filled with metal alloy particles 20 as shown in FIG. 2. Preferably, well known polishing equipment and materials are used which are well suited for the polishing of the metal alloy respectively employed, but unsuited for the polishing of the underlying metal carbide. This results in an automatic slowdown or termination of the polishing operation once a majority of the peaks 18 are exposed.

EXAMPLE

In a first coating step, a powder containing more that 99.5% molybdenum and having a particle size of maximum 1% +170 mesh and minimum 80% +325 mesh was injected into a Miller SP100 plasma gun and coated onto a 35 mm ×51 mm minor and major diameter stainless steel Moineau pump rotor (200TP1200) to a thickness of 50 micrometers. In a second coating step, coating powder containing 83% WC and 17% Co and having a particle size of 7.8 to 44 microns was injected into the same plasma. The distance of the plasma gun nozzle from the rotor surface was maintained at 7–10 cm. The powder injection rate was 2–4 grs/min at 100 kW of DC power. This resulted in a WC coating on the rotor of 125 micrometer thickness, after several coats were applied.

In a third coating step, a coating powder containing 20% chromium and 78.5% nickel and having a particle size of 91.7% −325 mesh was injected into the same plasma gun and coated onto the WC layer produced in the second coating step. The distance between the plasma gun nozzle and the rotor was kept at 7–10 cm. The powder injection rate was 3.2 grs/min at 100 kW of DC power. The resulting nickel/chromium coating had a thickness of about 125 micrometer, after several coats.

Polishing of the coated rotor was carried out on a conventional carriage mounted belt polishing machine until about 50% of the peaks of the WC layer were exposed.

The rotor thus obtained was tested in a deep oil well situation and used to pump highly viscous crude oil which contained corrosive agents and had a sand content of about 5%. The rotor proved to have a 3000% longer service life than conventional chrome-plated, high strength steel rotors of corresponding size.

Although the hardfacing method of the invention was described in detail only for the combination of a WC based layer filled in with a nickel/chromium alloy, the art-skilled person will readily appreciate that other metal carbide/metal alloy combinations can be used as long as the metal alloy respectively used has a lower hardness than the metal carbide with which it is combined. For example the carbides of tungsten, tantalum, titanium, columbium, vanadium and molybdenum can be advantageously overlaid with alloys of chrome, molybdenum and nickel, especially chrome/molybdenum and nickel/chromium alloys. Furthermore, any conventional coating process adapted for the coating of a metal carbide surface with a layer of a metallic material can be used for the application of the top layer.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. A method of hardfacing a rotor for a progressing cavity pump having a ferrous metal rotor body, comprising the steps of plasma spraying a metal carbide material onto the rotor body to form a metal carbide layer on the rotor body having a grainy surface with a multiplicity of peaks and intermediate depressions, the peaks being formed by metal carbide grains at the surface of the metal carbide layer;

applying a metallic material top layer onto the metal carbide layer at such a thickness that it completely covers the metal carbide layer; and polishing the top layer until a majority of the peeks of the metal carbide layer are exposed.

2. The method of claim 1, wherein the metal carbide material is selected from the group consisting of the carbides of tungsten, titanium, tantalum, columbium, vanadium and molybdenum end the metallic material is selected from the group consisting of chromium, molybdenum and nickel and alloys thereof.

3. The method of claim 1, wherein the metallic material is plasma sprayed onto the metal carbide layer.

4. The method of claim 1, wherein the metallic material is selected from the group consisting of the alloys of chromium, molybdenum, and nickel.

5. The method of claim 1, wherein the rotor body is made of stainless steel, the metal carbide material is tungsten carbide, and the metallic material is nickel/chromium alloy.

6. The method of claim 5, wherein the grain size of the tungsten carbide powder is 7.8 to 44 micrometer.

7. The method as defined in claim 1, wherein the rotor body has dimensions smaller than dimensions selected for the rotor and the metal carbide layer is applied to such a thickness that the diameter of the rotor body coated with the metal carbide layer is within the selected dimensions.

8. The method as defined in claim 7, wherein the top layer is polished until the coated rotor body is within the selected dimensions.

9. The method as defined in claim 8, wherein the top layer is first polished without exposing a majority of the peaks of the metal carbide layer are exposed and is subsequently put into operation in a progressing cavity pump for further polishing of the top layer by wear of the top layer until a majority of the peaks of the hardfacing layer are exposed.

10. The method of claim 1, wherein a bonding layer of molybdenum is applied onto the ferrous metal rotor body prior to the plasma spraying of the metal carbide layer thereonto.

* * * * *

UNITED STATES PATENT AND TRADEMARK OFFICE

CERTIFICATE OF CORRECTION

PATENT NO. : 5,645,896

DATED : July 8, 1997

INVENTOR(S) : ROBERT A.R. MILLS

It is certified that error appears in the above-identified patent and that said Letters Patent is hereby corrected as shown below:

Column 6, line 33, CLAIM 2, after "molybdenum" delete "end" and substitute therefore ---and---; Column 6, line 56, CLAIM 9, after "layer" delete "are exposed"

Signed and Sealed this

Third Day of February, 1998

*Attest:*

*Attesting Officer*

BRUCE LEHMAN

*Commissioner of Patents and Trademarks*